US006998986B2

(12) United States Patent
Smith

(10) Patent No.: US 6,998,986 B2
(45) Date of Patent: Feb. 14, 2006

(54) POWER LATCH FOR USE WITH AN ELECTRONIC PATIENT MONITOR

(75) Inventor: Toby E. Smith, Broken Arrow, OK (US)

(73) Assignee: Bed-Check Corporation, Tulsa, OK (US)

( * ) Notice: Subject to any disclaimer, the term of this patent is extended or adjusted under 35 U.S.C. 154(b) by 0 days.

(21) Appl. No.: 10/390,936

(22) Filed: Mar. 18, 2003

(65) Prior Publication Data

US 2004/0183681 A1 Sep. 23, 2004

(51) Int. Cl.
*G08B 23/00* (2006.01)

(52) U.S. Cl. ..... 340/573.1; 340/573.4; 340/573.7; 340/687; 340/286.02; 340/286.07

(58) Field of Classification Search ..... 340/573.1, 340/573.4, 573.7, 667, 286.02, 286.07
See application file for complete search history.

(56) References Cited

U.S. PATENT DOCUMENTS 4,179,692 A 12/1979 Vance
4,295,133 A 10/1981 Vance
4,484,043 A 11/1984 Musick et al.
4,565,910 A 1/1986 Musick et al.
4,700,180 A 10/1987 Vance
5,554,835 A 9/1996 Newham
5,600,108 A 2/1997 Newham
5,623,760 A 4/1997 Newham
5,633,627 A 5/1997 Newham
5,640,145 A 6/1997 Newham
5,654,694 A 8/1997 Newham
5,945,914 A 8/1999 Holmes et al.
5,990,799 A * 11/1999 Boon et al. ..... 340/667
6,065,727 A 5/2000 Fitzgerald et al.
6,111,509 A 8/2000 Holmes
6,292,102 B1 9/2001 Smith
6,307,476 B1 * 10/2001 Smith et al. ..... 340/573.1
6,417,777 B2 7/2002 Fitzgerald et al.
6,441,742 B1 8/2002 Lovely et al.
6,544,200 B1 * 4/2003 Smith et al. ..... 600/595

OTHER PUBLICATIONS

NERAC Patent Search.

* cited by examiner

*Primary Examiner*—Daryl C Pope
(74) *Attorney, Agent, or Firm*—Terry L. Watt; Fellers, Snider, Blankenship, Bailey & Tippens, P.C.

(57) ABSTRACT

There is provided herein an electronic patient monitor that utilizes a latch or similar power circuit that automatically activates an electronic patient monitor when a patient's presence is indicated by the sensor, that maintains power to the unit so long as the patient is indicated to be present, and that maintains power to the monitor until a valid reset command is issued after the patient is sensed to be no longer present. Power to the unit is maintained, and the unit continues to monitor the patient, e so long as the patient is present, even if an attempt is made to power down/disable the unit during that time.

12 Claims, 5 Drawing Sheets

POWER LATCH FOR USE WITH AN ELECTRONIC PATIENT MONITOR

This invention relates generally to monitoring systems and more particularly concerns devices and systems used to monitor seated or lying patients in homes or in medical environments such as hospitals, institutions, and other caregiving environments.

BACKGROUND OF THE INVENTION

The critical shortage of nurses and other health care professionals has lead to increasing dependence on electronic monitoring of patients. This ability to allow a caregiver to direct his or her attention elsewhere in reliance on an electronic component is obviously something that most hospitals and nursing homes are very interested in.

As one example of the sort of monitoring that is done, it is well documented that the elderly and post-surgical patients are at a heightened risk of falling. These individuals are often afflicted by gait and balance disorders, weakness, dizziness, confusion, visual impairment, and postural hypotension (i.e., a sudden drop in blood pressure that causes dizziness and fainting), all of which are recognized as potential contributors to a fall. Additionally, cognitive and functional impairment, and sedating and psychoactive medications are also well recognized risk factors.

A fall places the patient at risk of various injuries including sprains, fractures, and broken bones—injuries which in some cases can be severe enough to eventually lead to a fatality. Of course, those most susceptible to falls are often those in the poorest general health and least likely to recover quickly from their injuries. In addition to the obvious physiological consequences of fall-related injuries, there are also a variety of adverse economic and legal consequences that include the actual cost of treating the victim and, in some cases, caretaker liability issues.

Of course, direct monitoring of high-risk patients, as effective as that care strategy might appear to be in theory, suffers from the obvious practical disadvantage of requiring additional staff if the monitoring is to be in the form of direct observation. Of course, such continuous visual monitoring, in addition to being impractical, can intrude on a patient's legitimate and legal need for some amount of privacy. Thus, the trend in patient monitoring has been toward the use of electrical devices to signal changes in a patient's circumstance to a caregiver who might be located either nearby or remotely at a central monitoring facility, such as a nurse's station. The obvious advantage of an electronic monitoring arrangement is that it frees the caregiver to pursue other tasks away from the patient. Additionally, when the monitoring is done at a central facility a single person can monitor multiple patients which can result in decreased staffing requirements.

Generally speaking, electronic monitors work by first sensing an initial status of a patient, and then generating a signal when that status changes, e.g., he or she has sat up in bed, left the bed, risen from a chair, etc., any of which situations could pose a potential cause for concern in the case of an at-risk patient. Electronic bed and chair monitors typically use a pressure sensitive switch in combination with a separate electronic monitor which might utilize a microprocessor or other logical device of some sort. In a common arrangement, a patient's weight resting on a pressure sensitive mat (i.e., a "sensing" mat) completes an electrical circuit, thereby signaling the presence of the patient to the monitor. When the weight is removed from the pressure sensitive switch, the electrical circuit is interrupted, which fact is similarly sensed by the monitor. The monitor responds to the now-opened circuit by triggering some sort of alarm—either electronically (e.g., to the nursing station via a conventional nurse call system) or audibly (via a built-in siren) or both. Additionally, many variations of this arrangement are possible and electronic monitoring devices that track changes in other patient variables (e.g., wetness/enuresis, patient activity/inactivity, etc.) are available for some applications.

General information relating to mat sensors and electronic monitors for use in patient monitoring may be found in U.S. Pat. Nos. 4,179,692, 4,295,133, 4,700,180, 5,600,108, 5,633,627, 5,640,145, 5,654,694, and 6,111,509 (the last of which concerns electronic monitors generally). Additional information may be found in U.S. Pat. Nos. 4,484,043, 4,565,910, 5,554,835, 5,623,760, 6,417,777 (sensor patents) and U.S. Pat. No. 5,065,727 (holsters for electronic monitors), the disclosures of all of which patents are all incorporated herein by reference. Further, U.S. Pat. No. 6,307,476 (discussing a sensing device which contains a validation circuit incorporated therein), and U.S. patent Ser. Nos. 09/944,622, (for automatically configured electronic monitor alarm parameters), and Ser. No. 10/125,059 (for a lighted splash guard) are similarly incorporated herein by reference.

Note that the instant invention is suitable for use with a wide variety of patient sensors in addition to pressure sensing switches including, without limitation, temperature sensors, patient activity sensors, toilet seat sensors (see, e.g., U.S. Pat. No. 5,945,914), wetness sensors (e.g., U.S. Pat. No. 6,292,102), decubitus ulcer sensors (e.g., U.S. patent application Ser. No. 09/591,887), etc. Thus, in the text that follows the terms "mat" or "patient sensor" should be interpreted in its broadest sense to apply to any sort of patient monitoring switch or device, whether the sensor is pressure sensitive or not.

One perennial problem with using an electronic alarm to monitor a patient is that such electronics are prone to being tampered with by the patient. That is, many patients quickly learn that those electronic monitors that have an manually operated on/off switch (or, in some cases, a functionally equivalent reset/hold switch) that will disable the unit, thereby allowing them to exit the bed without raising an alarm. Of course, the ability to power down (or reset) the monitor is a desirable feature both from a power savings standpoint and from the point of view of the care giver, as it allows the unit to be quickly disabled when the patient is removed from the sensor and quickly terminates the sounding of a disruptive alarm which such is not appropriate. Further, accreditation associations such as Joint Commission for the Accreditation of Health Organizations will not certify an institution where equipment is used that has an on/off switch that can be operated the patient. However, that feature can be turned against the caregiver if the patient is easily able to activate it.

Thus, what is needed is an electronic patient monitor which can be readily powered down/disabled by the caregiver but which is resistant to tampering by the patient.

Heretofore, as is well known in the patient monitor arts, there has been a need for an invention to address and solve the above-described problems and, more particularly, there has been a need for an electronic patient monitor that utilizes an external power-down switch but which is resistant to tampering by the patient. Accordingly, it should now be recognized, as was recognized by the present inventor, that there exists, and has existed for some time, a very real need for a system for monitoring patients that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

In accordance with a first aspect of the instant invention, there is provided an electronic patient monitor that utilizes a latch or similar power circuit to automatically activate an electronic patient monitor when a patient's presence is indicated by the sensor, to maintain power to the unit so long as the patient is indicated to be present, and to only allow the power to be terminated by receipt of a signal from the reset/hold button after the patient is sensed to be no longer present.

In a first preferred arrangement of the instant invention, there is provided an electronic patient monitor substantially as described previously, but wherein the electronic patient monitor has a reset switch which deprives the monitor of power only in the event that the patient is no longer present at the time when the reset switch is activated. That is, in this embodiment a patient will not be able to deactivate the monitor (and thus defeat it) so long as the attached sensor continues to register the patient's presence. It is only after the patient has departed that the reset switch can be used to reset/deactivate/power down the unit.

According to still another preferred arrangement, there is provided an electronic patient monitor substantially as described above, but wherein the patient monitor utilizes a microprocessor to control its operations. It should be clear to those of ordinary skill in the art that the programmability of a microprocessor makes it imminently suited to this sort of application and, although it is not required that the instant invention utilize such an element, in a preferred arrangement a microprocessor will be used.

The foregoing has outlined in broad terms the more important features of the invention disclosed herein so that the detailed description that follows may be more clearly understood, and so that the contribution of the instant inventor to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Further, the disclosure that follows is intended to apply to all alternatives, modifications and equivalents as may be included within the spirit and scope of the invention as defined by the appended claims. Finally, it should be understood that the phraseology and terminology employed herein are for the purpose of description and should not be regarded as limiting, unless the specification specifically so limits the invention.

While the instant invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

BRIEF DESCRIPTION OF THE DRAWINGS

Other objects and advantages of the invention will become apparent upon reading the following detailed description and upon reference to the drawings in which.

DETAILED DESCRIPTION OF THE INVENTION

According to a preferred aspect of the instant invention, there is provided an electronic patient monitor for use with a patient sensor, wherein the monitor cannot readily be powered down or otherwise disabled by the patient.

GENERAL BACKGROUND

Figure 1:
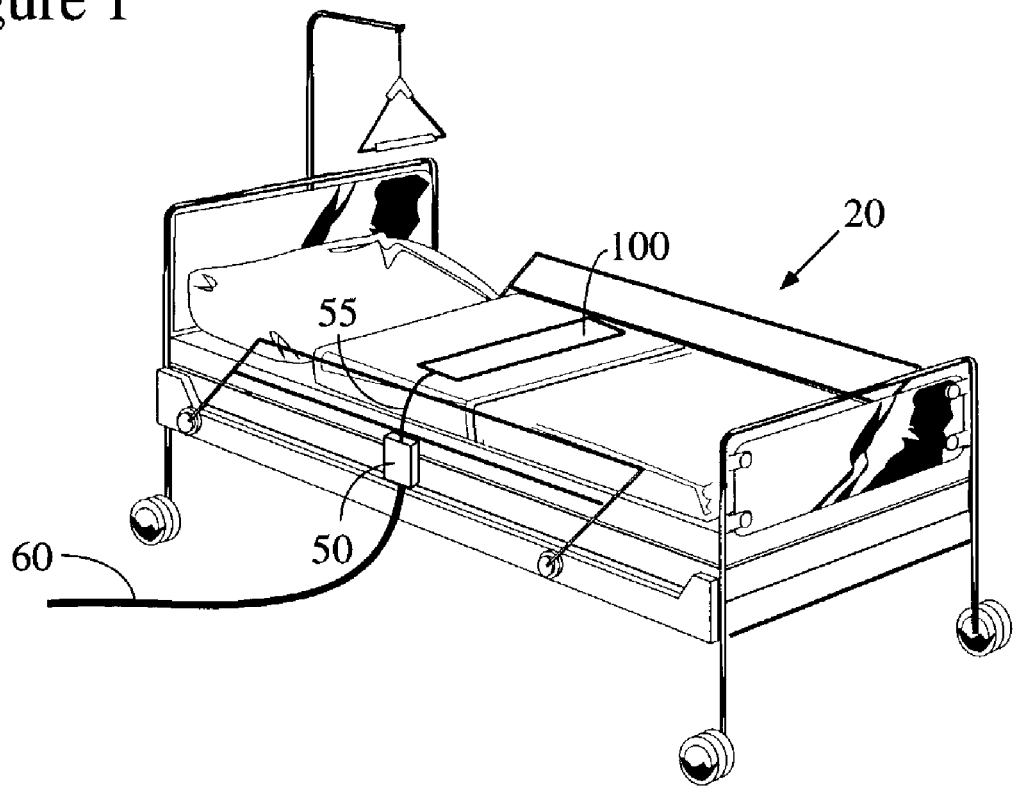
FIG. 1 illustrates the general environment of the instant invention, wherein an electronic patient monitor is connected to a bed mat.

Generally speaking, electronic patient monitors of the sort discussed herein work by first sensing an initial status of a patient, and then generating a signal when that status changes (e.g., the patient changes from laying or sitting to standing, the sensor changes from dry to wet, etc.). Turning now to FIG. 1 wherein the general environment of one specific embodiment of the instant invention is illustrated, in a typical arrangement a pressure sensitive mat 100 sensor is placed on a hospital bed 20 where it will lie beneath a weight-bearing portion of the reclining patient's body, usually the buttocks and/or shoulders. Generally speaking, the mat 100/electronic monitor 50 combination works as follows. When a patient is placed atop the mat 100, the patient's weight compresses the mat 100 and closes an electrical circuit, which closure is sensed by the attached electronic patient monitor 50. When the patient attempts to leave the bed, weight is removed from the sensing mat 100, thereby breaking the electrical circuit, which interruption is sensed by the attached electronic patient monitor 50. The patient monitor, which might contain a microprocessor therein, then signals the caregiver per its pre-programmed instructions. In some cases, the signal will amount to an audible alarm or siren that is emitted from the unit. In other cases, an electronic signal could be sent to a remote nurses/caregivers station via electronic line 60. Note that additional electronic connections not pictured in this figure might include a monitor power cord to provide a source of AC power, although, as generally pictured in this figure, the monitor 50 can certainly be configured to be either battery or AC powered.

Figure 2:
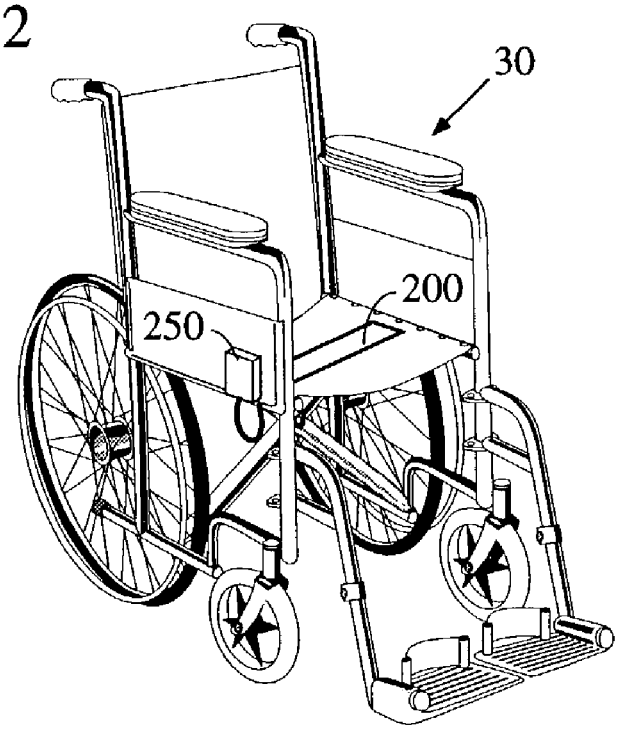
FIG. 2 illustrates the general environment of the instant invention, wherein an electronic patient monitor is connected to a chair mat.

In another common arrangement, and as is illustrated in FIG. 2, a pressure sensitive chair sensor 200 might be placed in the seat of a wheel chair or the like for purposes of monitoring a patient seated therein. As has been described previously, a typical configuration utilizes a pressure sensitive mat 200 which is connected to electronic chair monitor 250 that is attached to the chair 30. Because it is anticipated that the patient so monitored might choose to be at least somewhat mobile, the monitor 250 will usually be battery powered and will signal a chair-exit event via an internal speaker, rather than a nurse-call interface.

PREFERRED EMBODIMENTS

Figure 3:
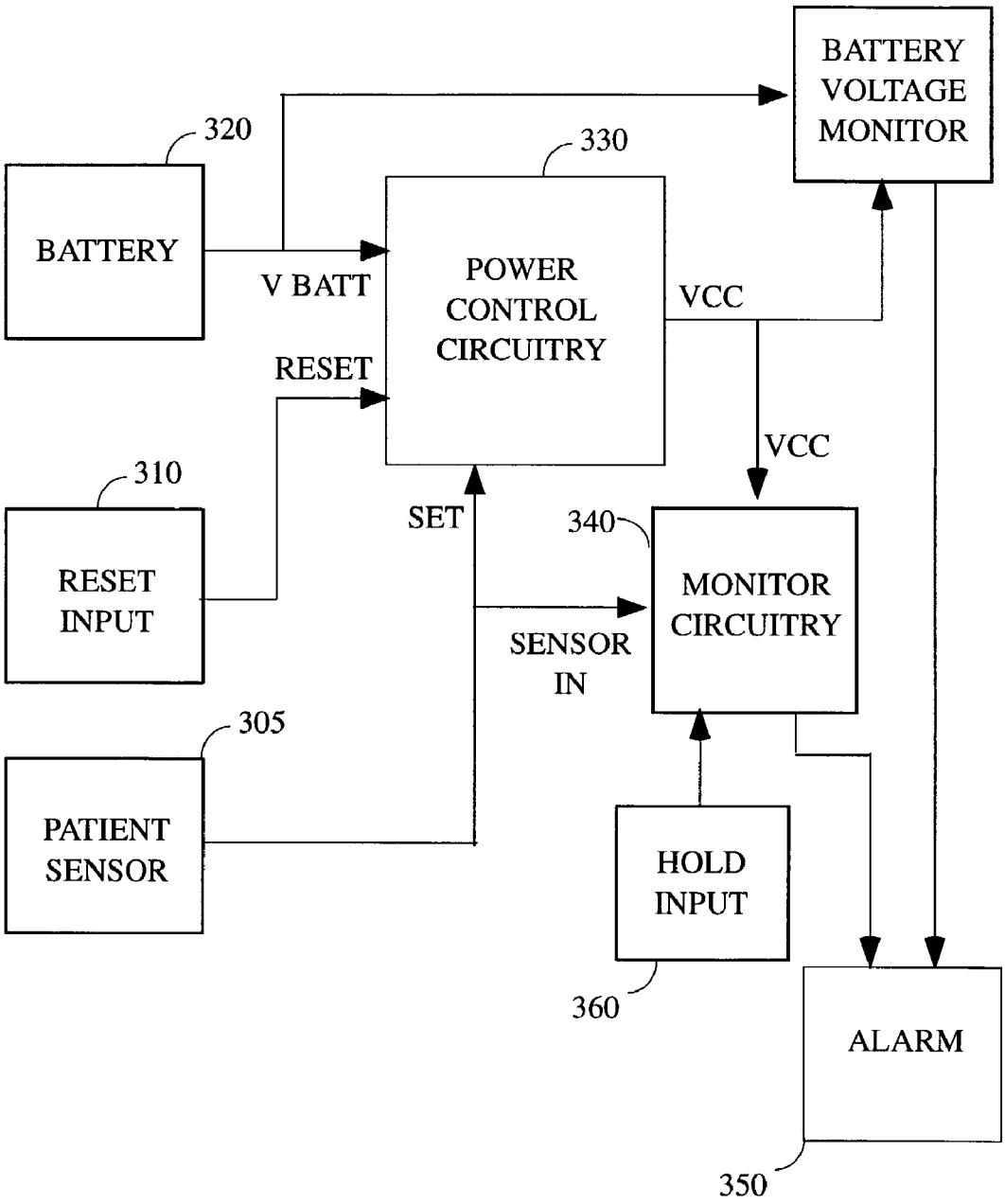
FIG. 3 contains an illustration of the main features of a preferred embodiment of the instant patient monitor.

In accordance with a first aspect of the instant invention, there is provided an electronic patient monitor that utilizes a latch or similar circuit to automatically activate an electronic patient monitor when a patient's presence is indicated by the sensor, to maintain power to the unit so long as the patient is indicated to be present, and to maintain power to the monitor until such time as the patient is sensed to be no longer present and the power latch has been reset with the reset switch. As is generally indicated in FIG. 3, the preferred embodiment of the instant invention utilizes a patient sensor 305 which is placed proximate to the patient and is for sensing the changing state of the patient over time.

By way of a specific example, in a preferred embodiment, the patient sensor 305 will be a pressure sensitive mat and the monitor circuitry 340 will be designed to sound an alarm (preferably through alarm/speaker circuitry 350) when the patient's weight is no longer detected on the sensor. Obviously, and depending on the nature of the sensor, other changes in the patient's condition might also be signaled. As another example, if the sensor 305 is a wetness sensor, the change in condition that would trigger an alarm would be the detection of moisture. Those of ordinary skill in the art will recognize that many other alternatives and variations are possible within this basic configuration.

The patient sensor 305 will preferably be in electronic communication with the power control circuitry 330 of the instant invention and with the monitor circuitry 340. It should be noted that for purposes of the instant disclosure that the term "electronic communication" should be interpreted in its broadest sense to include conventional electrical wiring, as well as wireless communication technologies such as infrared, RF, the IEEE 802.11 wireless standard, Bluetooth, etc.

A main purpose of the monitor circuitry 340 is to activate alarm circuitry 350, thereby initiating the sounding of an audible alarm, when a change in the condition of the patient is detected. In a preferred arrangement, the alarm 350 will comprise a loudspeaker of some sort, alarm generation circuitry (if needed), and, a power amplifier (if needed).

The loudspeaker is preferably a simple two inch polydome cone-type speaker. However, it should be noted that other arrangements are certainly possible and it is within the ordinary skill of in the art to devise such. By way of example only, the loudspeaker element might be a piezoelectric device (e.g., a piezo ceramic transducer) that is capable of directly generating an audible alarm signal. Thus, when the term "loudspeaker" is used hereinafter, that term should be construed in the broadest possible sense to include any device capable of emitting an audible alarm signal under the control of the monitor circuitry. Additionally, when loudspeaker is used herein that term should also be taken to include an associated power amplifier, if one is necessary from the context of its use (as it usually will be). Finally, it should also be noted that it is not an essential element of the instant invention that the loudspeaker be found within the body of the monitor. The speaker could also be mounted externally to the monitor, and, as an extreme example, might by located in an adjacent hallway or at the nurses station.

The purpose of the alarm generation circuitry is to create the particular alarm sound which is to be broadcast via the loudspeaker component of the alarm 350. Note that the alarm generation circuitry could be separate from the monitor circuitry 340 or incorporated into it, depending on the needs of the designer. By way of explanation, in one preferred embodiment the instant invention utilizes synthesis to create the alarm sounds. In the event that monitor circuitry 340 contains a microprocessor, the synthesis might be performed internal to that device and such synthesis could be something as complex as playing a "MIDI" file or an MP3 or other digital sound file (e.g., a .WAV file, a .SND file, etc.) through the loudspeaker, mathematically generating digital patterns (e.g., square waves, triangle waves, sine waves, etc.), or as simple as repeatedly turning the speaker "on" and "off" under microprocessor control to create a simple constant-level alarm sound. In other preferred arrangements, the synthesis might be performed externally to the monitor circuitry 340/microprocessor and might involve a separate synthesis circuit which might digitally synthesize the desired sound or play a pre-recorded digitized sound (e.g., a voice that asks the patient to return to the bed). Additionally, although digital synthesis is the preferred embodiment, analog sound generation sources might also be used to produce beeps, warbles, frequency sweeps, etc., according to methods well known to those of ordinary skill in the art. In summary, the sound generation circuitry might be implemented in software, hardware, or some combination thereof. The sound generation might be performed within the monitor circuitry 340 (which might or might not contain a microprocessor) or external thereto. All of this is well known to those or ordinary skill in the art.

Figure 4:
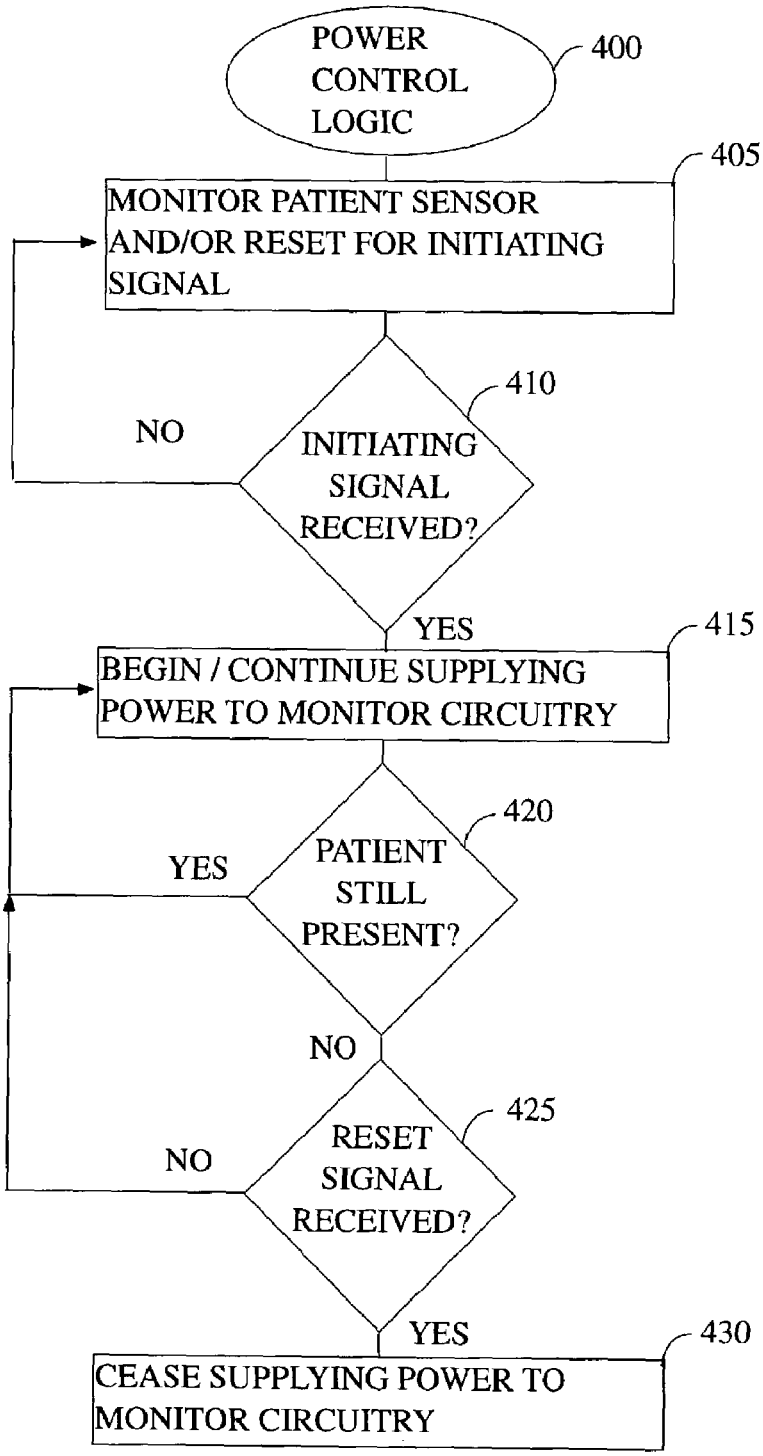
FIG. 4 is a schematic illustration of a preferred operating logic of the instant invention.

Turning now to the power control circuitry 330, the broad functionality/control logic 400 of a preferred embodiment of that circuit may be found illustrated within FIG. 4. In a preferred arrangement the power control circuit 330 will be in electrical communication with the patient sensor 305 as well as a user-operated reset button 310 and will continuously monitors both of these Note that for purposes of the instant invention, the term "monitor" should be interpreted in its broadest sense to include "active" monitoring of the sort provided by a programmed microprocessor, as well as "passive" monitoring which is based on the response of a hard-wired circuit to a switch opening, closing, etc. within the sensor.

Upon receipt of a signal that indicates that the patient is in a position to be monitored (e.g., in the case of a pressure sensitive mat, the "signal" would be the lowered resistance that indicates a switch closure or, alternatively, the "reset" button 310 might be pressed), the power control circuitry 330 will begin supplying power to the monitor circuitry 340, (i.e., the "YES" branch of decision point 410 will be taken) step 415 of FIG. 4.

Thereafter, the power control circuitry 330 will continue to supply electrical power to the monitor circuitry 340 until the patient is no longer present (step 420) and until a "reset" is received by the power control circuitry (step 425). It is only upon the satisfaction of both of these conditions—receipt of both of the associated signals—that the power control circuitry 330 will cut off power to the monitor circuitry 340, thereby powering down the unit (step 430). A main purpose of this arrangement is as follows. Monitored patients quickly learn how to disable their electronic watch dogs by observing the nursing staff depress the reset (or "power down") switch on conventional patient monitors. Of course, once a conventional monitor is deactivated, the patient may remove the sensor, leave the area, etc., without any warning being given to the care giver. In any case, a monitor that is powered down is not functioning to detect the changes in the patient's condition and, as might be expected, the caregiver will continue to assume otherwise until the monitor and patient are next visually checked.

However, a monitor that operates according to the instant embodiment cannot be so easily disabled. Consider, for purposes of specificity, the case where the sensor is a pressure sensitive mat. If, as is conventionally done, the monitor is placed within reach of the patient, the patient may very well attempt to deactivate the monitor by pressing the reset/hold button and thereafter exiting the bed. However, such an attempt to escape will be thwarted by the instant invention. Pressing the reset/hold button while there is still weight on the mat (i.e., while the patient is still present) will not power down or otherwise deactivate the monitor. In order to deactivate the monitor, the patient must leave the mat and then press the reset/hold button, thereby activating its alarm (if only briefly), and, thus, informing the caregiver that the patient is not where he or she had previously been placed.

Finally, in some configurations it might be desirable to include a hold switch 360 which is placed in electronic communication with the monitor circuitry 340. The general functions of such a switch 360 are conventionally to signal to the monitor circuitry 360 that a currently-sounding alarm is to be silenced and/or to temporarily disable the monitor circuitry 360 so that a patient can be removed from the sensor 305 without sounding an alarm. However, the second-such conventional function of the hold switch 360—i.e., temporarily suspending operation of the monitor—360 would be inapposite to the spirit of the instant invention and, while it could certainly be included as part of the instant invention, the instant inventor recommends against it.

Figure 5:
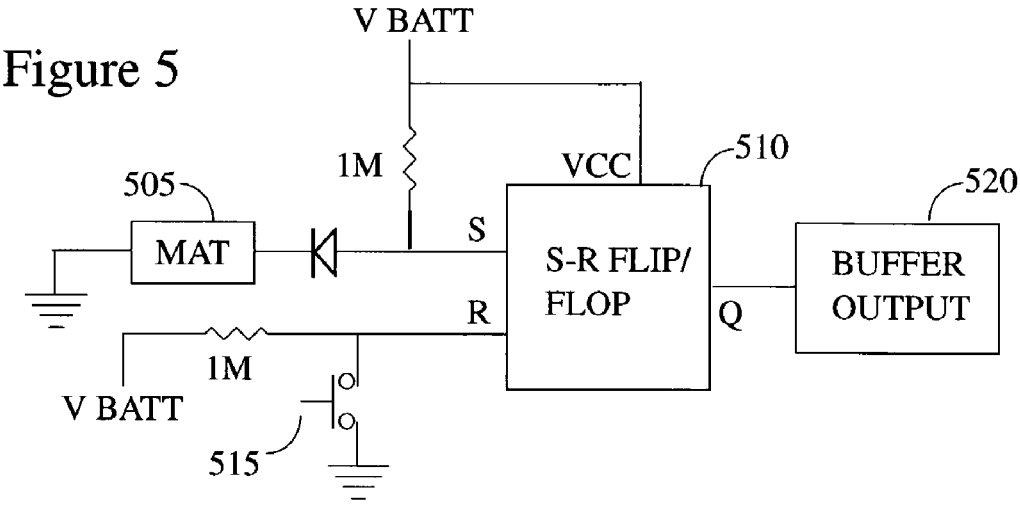
FIG. 5 contains a preferred hardware embodiment of the power control circuitry of the instant invention.

FIG. 5 contains a preferred embodiment of the instant power control circuitry 330. As may be seen in that figure, in the preferred arrangement the power control circuitry 330 is built around a set/reset flip-flop circuit 510. As those of ordinary skill in the art will understand, when mat 505 is closed it will pull down input "S." Assuming that the reset switch 515 has not been engaged, input "R" will be "high" and, hence, output from the flip-flop circuit 510 will be allowed, thus current passes on to the buffer 520 and thereafter to the monitor circuitry 340. In the event that an attempt is made to deactivate the monitor while input "S" is still high (i.e., while the patient is still present), such an attempt will be unsuccessful by virtue of the instant design.

Those of ordinary skill in the art will recognize that when the hardware of FIG. 4 is used, the only circumstance that will result in power being removed from the monitor circuitry is in the event that the "S" input is low and the "R" input is high (i.e., there is no patient on the mat and the reset circuit 415 has been engaged). Of course, it should be clear that the above-described preferred embodiment is only one of many possible configurations that accomplishes the goal of maintaining power to a patient monitor circuit so long as the patient is still present. Those of ordinary skill in the art are capable of creating many alternative circuits that will implement the aim of this invention.

As some specific examples, the instant inventors have contemplated the use of alternative hardware devices such as "T" (toggle) flip-flops, "J-K" switches, "D-type" flip-flops, "gated R-S" flip-flops, master/slave flip-flops, "RST" flip-flop, etc., as the power control circuitry 330. Additionally, even counters, dividers, etc. could be used (each of which is really just a plurality of logic gates in series). What is common in all of these devices is that each is an example of a bistable device that draws a minimal amount of power when in the quiescent state. Needless to say, this particular feature is quite desirable in battery powered units. Thus, for purposes of the instant disclosure when the terms "flip/flop" or "S-R flip/flop" are used, those terms should be understood to mean any hardware device that functions similarly to those listed above.

Figure 6:
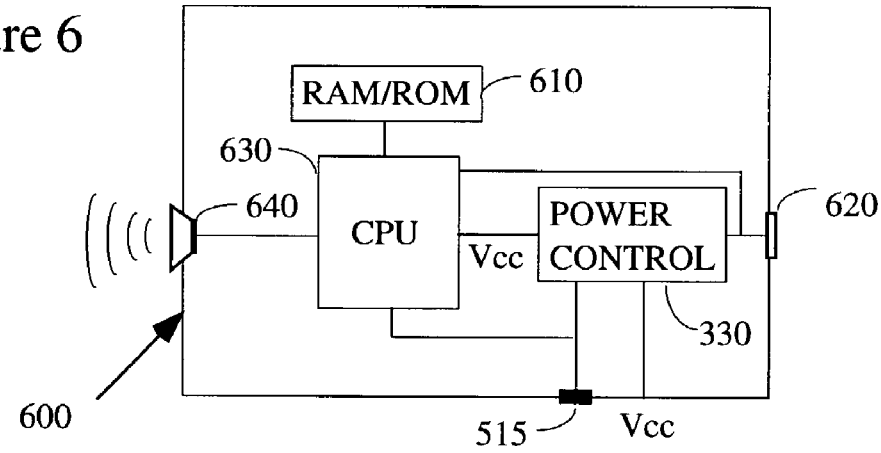
FIG. 6 illustrates a preferred variation of the instant invention, wherein a microprocessor is utilized as a component of the monitor circuitry.
Figure 7:
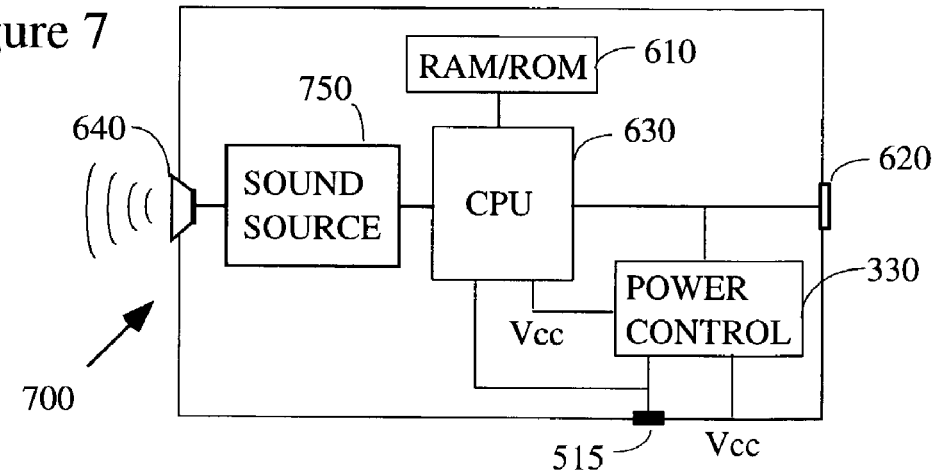
FIG. 7 illustrates a preferred variation of the instant invention, wherein a microprocessor is utilized in connection with a separate sound source as a component of the monitor circuitry.

Further, although a preferred embodiment of the monitor circuitry 340 could include a microprocessor which is designed to execute computer instructions according to its internal programming, those of ordinary skill in the art will recognize that there are many active devices that could serve for purposes of the instant invention as a CPU including, of course, a conventional microcontroller or microprocessor. More particularly and as is generally illustrated in FIGS. 6 and 7, in a first preferred configuration 600 a microprocessor 630 will be used in conjunction with power control circuitry 330 to monitor the patient and generate alarms according to its programming. It is conventional to supply the microprocessor 630 with some amount of RAM/ROM 610 in which to store its programming instructions and data. Additionally, electronic access to the patient sensor port 620 as well as the reset button 310 is preferably provided. The storage that is provided to the microprocessor 630 would typically contain, among other things, the software that control's the monitor's 600 operations. Although FIG. 6 indicates that in the preferred arrangement the RAM/ROM 610 is separate from the microprocessor 630, those of ordinary skill in the art will recognize that in many cases microprocessors are available which have some small amount of RAM and/or ROM available internally. Thus, FIG. 6 should be understood to include those configurations where the computer memory is either internal or external to the microprocessor. The alarm which, in this embodiment, originates from the microprocessor (by, for example synthesis) is broadcast via loudspeaker 640.

In a second preferred arrangement 700 and as is best illustrated in FIG. 7, the microprocessor 630 is programmed to respond to changing patient conditions by utilizing a separate sound source 750. That is, in this preferred arrangement, the monitor circuitry is implemented in software within CPU 630 as has been described previously. However, in this instance the actual alarm sound is created within a separate sound source 750 for subsequently broadcast via speaker 640. Thus, when the CPU 630 detects that the patient's condition has changed (e.g., the patient has departed from the attached mat 505) it will send an electronic signal to sound source 750, instructing it to generate a particular alarm sound.

Figure 8:
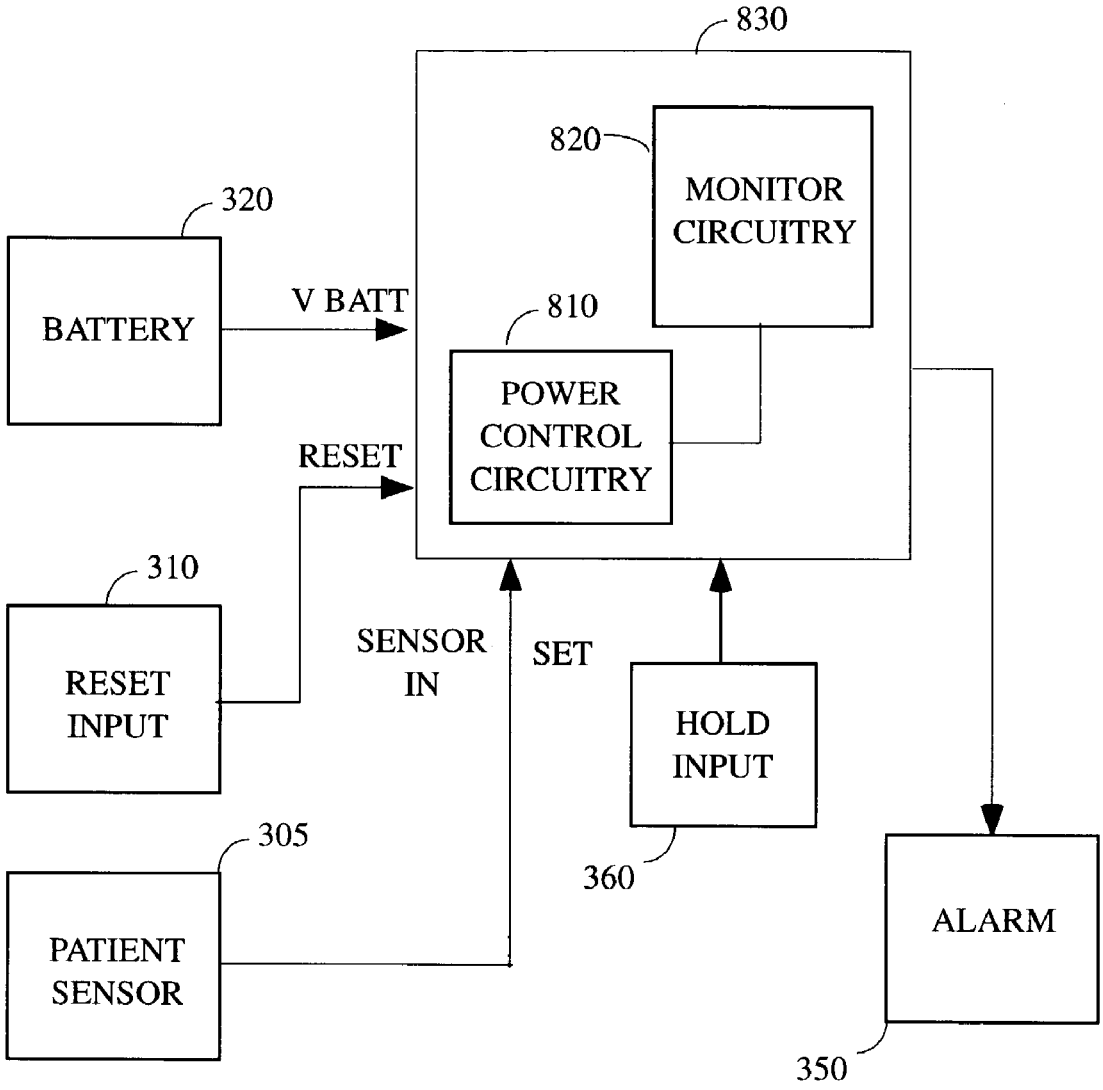
FIG. 8 illustrates another preferred embodiment of the instant invention, wherein the monitor circuitry and flip/flop are incorporated within a single PLD.

According to still another preferred embodiment, and as is generally set out in FIG. 8, there is provided an electronic patient monitor substantially as described above, but wherein the power control circuitry 810 and monitor circuitry 820 are incorporated into a single PLD 830 as that term is known in the industry and defined hereinafter. That is, those of ordinary skill in the art will recognize that the functionality of the S-R flip/flop 510 can readily be implemented with gate array or discrete logic. Similar, the monitor control circuitry 340 could also be incorporated within the same PLD 830. In such an arrangement, the power control circuitry 810 would supply power to/remove power from the monitor circuitry 820 depending on the patient's presence/absence as has been described previously. The main distinction between the instant embodiment and those discussed previously is that in the present embodiment power will not be terminated to the entire PLD 830, but only to that portion of its internal gate array logic that is responsible for monitoring the patient.

It should be noted and remembered that if a microprocessor is utilized as a component of the monitor circuitry 340, the only requirement that such a component must satisfy is that it must minimally be an active device, i.e., one that is programmable in some sense, that it is capable of recognizing signals from a bed mat or similar patient sensing device, and that it is capable of initiating the sounding of one or more alarm sounds in response thereto. Of course, these sorts of modest requirements may be satisfied by any number of programmable logic devices ("PLD") including, without limitation, gate arrays, FPGA's (i.e., field programmable gate arrays), CPLD's, EPLD's, SPLD's, PAL's, FPLA's, FPLS, GAL, PLA, FPAA, PSoC, SoC, CSoC, ASIC, etc., as those acronyms and their associated devices are known and used in the art. Further, those of ordinary skill in the art will recognize that many of these sorts of devices contain microprocessors integral thereto. Thus, for purposes of the instant disclosure the terms "processor," "microprocessor" and "CPU" should be interpreted to take the broadest possible meaning herein, and such meaning is intended to include any PLD or other programmable device of the general sort described above.

CONCLUSIONS

It should be noted and remembered that a preferred electronic monitor of the instant invention utilizes a microprocessor with programming instructions stored therein for execution thereby, which programming instructions define the monitor's response to the patient and environmental sensors. Although ROM is the preferred apparatus for storing such instructions, static or dynamic RAM, flash RAM, EPROM, PROM, EEPROM, or any similar volatile or nonvolatile computer memory could be used. Further, it is not absolutely essential that the software be permanently resident within the monitor, although that is certainly preferred. It is possible that the operating software could be stored, by way of example, on a floppy disk, a magnetic disk, a magnetic tape, a magneto-optical disk, an optical disk, a CD-ROM, flash RAM card, a ROM card, a DVD disk, or loaded into the monitor over a network as needed. Additionally, those of ordinary skill in the art will recognize that the memory might be either internal to the microprocessor, or external to it, or some combination. Thus, "program memory" as that term is used herein should be interpreted in its broadest sense to include the variations listed above, as well as other variations that are well known to those of ordinary skill in the art.

Additionally, and as discussed previously, it should be clear to those of ordinary skill in the art that the masking sounds described above could easily be synthesized directly by the microprocessor, by a separate chip under control of the microprocessor, or by a "voice chip" or similar hardware sound recording device. Thus, in the text that follows, when the terms "generate" or "initiate" are used in connection with the creation of alarm sounds, those terms should be interpreted in its broadest sense to include those situations where the microprocessor itself "generates" the alarm sound, as well as those cases where the microprocessor directs a separate hardware component to produce the sound.

Further, the instant invention has a substantial advantage over the prior art in that its current draw in the quiescent state is so small that it has the potential to dramatically extend battery life in units that are powered by batteries. Of course, a key factor in that improvement is obtained by way of the inventor's choice of power control circuitry 330.

Finally, it should be noted that the term "nurse call" as that term has been used herein should be interpreted to mean, not only traditional wire-based nurse call units, but more also any system for notifying a remote caregiver of the state of a patient, whether that system is wire-based or wireless (e.g., R.F., ultrasonic, IR link, etc.). Additionally, it should be clear to those of ordinary skill in the art that it may or may not be a "nurse" that monitors a patient remotely and, as such, nurse should be broadly interpreted to include any sort of caregiver, including, for example, untrained family members and friends that might be signaled by such a system.

Thus, it is apparent that there has been provided, in accordance with the invention, a patient sensor and method of operation of the sensor that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. An electronic patient monitor for use with a patient sensor, said patient sensor at least for detecting a presence or an absence of a patient, comprising:

(a) monitor circuitry in electronic communication with said patient sensor, said monitor circuitry at least for monitoring the patient sensor and initiating an alarm in response to the patient's absence;

(b) a manually activated reset/hold switch;

(c) power control circuitry in electrical communication with said patient sensor, said reset/hold switch and said monitor circuitry, said power control circuitry at least for (i) supplying power to said monitor circuitry upon a detection of the patient on said patient sensor, (ii) continuing to supply power to said monitor circuitry operation of the monitor for so long as said detection of the patient on said sensor continues, and, (iii) terminating power to said monitor circuitry only after (1) said sensor detects the absence of the patient, and, (2) said reset/hold switch is manually activated; and, (d) a speaker in electronic communication with said monitor circuitry, said speaker at least for sounding an audible alarm under control of said monitor circuitry.

2. An electronic patient monitor according to claim 1, wherein said monitor circuitry comprises:

(a1) a microprocessor in electrical communication with said patient sensor, said microprocessor being responsive to a program resident therein, said program at least containing a plurality of computer instructions for:

(i) monitoring said patient sensor, and, (ii) initiating an alarm through said speaker if the sensor detects the absence of the patient.

3. An electronic patient monitor according to claim 1, wherein said speaker is a piezoelectric speaker.

4. An electronic patient monitor according to claim 1, wherein said monitor circuitry comprises:

(a1) a first circuit in electronic communication with said patient sensor, said first circuit at least for monitoring said patient sensor and for initiating an electronic alarm signal when said sensor detects the absence of the patient, and, (a2) an alarm circuit in electronic communication with said monitor circuit, said alarm circuit responding at least to said alarm signal from said first circuit and generating an alarm sound for broadcast through said speaker in response thereto.

5. An electronic patient monitor according to claim 4, wherein said first circuit comprises a microprocessor.

6. An electronic patient monitor according to claim 1, wherein said monitor circuitry and said power control circuitry are both implemented within a same PLD.

7. An electronic patient monitor according to claim 1, wherein said monitor circuitry comprises a first PLD and said power control circuitry comprises a second PLD.

8. An electronic patient monitor according to claim 4, wherein the step of generating an alarm sound for broadcast through said speaker comprises the step of synthesizing an alarm sound for broadcast through said speaker.

9. A method of monitoring a patient, wherein is provided a patient sensor positionable to be placed proximate to the patient, said patient sensor at least for determining a presence and an absence of the patient and for generating a signal at least in response to the patient's presence and absence, and, an electronic patient monitor in electrical communication with said sensor and responsive thereto, said electronic patient monitor at least having a user-operated switch for manually terminating/suspending its patient monitoring function, comprising the steps of:

(a) receiving within said electronic patient monitor a signal from said patient sensor indicative of the patient's presence;

(b) automatically initiating said monitoring function of said electronic patient monitor upon receipt of said signal indicative of the patient's presence;

(c) automatically generating an alarm if the patient sensor indicates the absence of the patient;

(d) continuing to monitor said patient sensor so long as the patient's presence is still indicated, even if said user-operated switch for manually terminating said patient monitoring function is engaged; and, (e) only ceasing the monitoring of the patient (i) after a signal is received from the patient sensor indicating that the patient is absent, and (ii) after said user-operated switch for manually terminating said patient monitoring function is engaged.

10. A method of monitoring a patient according to claim 9, wherein the step of ceasing the monitoring of the patient comprises the step of powering-down said electronic patient monitor.

11. A method of monitoring a patient according to claim 9, wherein patient sensor is a pressure sensitive mat.

12. An electronic patient monitor, comprising:

(a) a patient sensor, said patient sensor positionable to be proximate to a patient, said patient sensor at least for detecting a presence and an absence of the patient;

(b) a power source;

(c) a reset switch, said reset switch generating a reset signal when manually engaged by a user;

(d) a patient monitor circuit, said patient monitor circuit at least for monitoring the patient sensor and initiating an alarm in response to the patient's absence; and, (e) an S-R flip/flop circuit in electrical communication with said power source, with said reset switch, with said patient monitor circuit, and with said patient sensor, said S-R flip/flop circuit (i) supplying power to said patient monitor circuit upon receipt from said patient sensor of a signal indicating the patient's presence, and, (ii) maintaining power to said patient monitor circuit until after said S-R flip/flop circuit receives a signal indicating the patient's absence, and until after said S-R flip/flop circuit receives said reset signal from said reset switch after the patient's absence is detected.

* * * * *